US012279651B2

(12) United States Patent
Ballesteros Gomez et al.

(10) Patent No.: US 12,279,651 B2
(45) Date of Patent: Apr. 22, 2025

(54) AEROSOL GENERATION

(71) Applicant: NICOVENTURES TRADING LIMITED, London (GB)

(72) Inventors: Pablo Javier Ballesteros Gomez, London (GB); Jeremy Phillips, London (GB)

(73) Assignee: NICOVENTURES TRADING LIMITED, London (GB)

( * ) Notice: Subject to any disclaimer, the term of this patent is extended or adjusted under 35 U.S.C. 154(b) by 17 days.

(21) Appl. No.: 15/733,149

(22) PCT Filed: Nov. 15, 2018

(86) PCT No.: PCT/EP2018/081393
§ 371 (c)(1),
(2) Date: May 28, 2020

(87) PCT Pub. No.: WO2019/105750
PCT Pub. Date: Jun. 6, 2019

(65) Prior Publication Data

US 2021/0100283 A1 Apr. 8, 2021

(30) Foreign Application Priority Data

Nov. 28, 2017 (GB) ..... 1719747

(51) Int. Cl.
*A24F 40/46* (2020.01)
*A24C 5/01* (2020.01)
(Continued)

(52) U.S. Cl.
CPC ..... *A24F 40/46* (2020.01); *A24C 5/47* (2013.01); *A24D 1/20* (2020.01); *A24D 3/17* (2020.01);
(Continued)

(58) Field of Classification Search
CPC ..... A24F 40/46; A24F 40/30; A24F 40/20; A24D 1/20; A24D 1/002; A24D 3/17; A24C 5/47; A24C 5/01
See application file for complete search history.

(56) References Cited

U.S. PATENT DOCUMENTS

D22,270 S 3/1893 Marshall
D27,458 S 8/1897 Alexander
(Continued)

FOREIGN PATENT DOCUMENTS

CN 204907924 12/2015
CN 105411005 A 3/2016
(Continued)

OTHER PUBLICATIONS

International Search Report, Application No. PCT/EP2018/081393, dated May 14, 2019, 7 pages.
(Continued)

*Primary Examiner* — Michael H. Wilson
*Assistant Examiner* — Stephanie Lynn Moore
(74) *Attorney, Agent, or Firm* — Husch Blackwell

(57) ABSTRACT

Described herein is an aerosol generating assembly including a heater and an aerosolizable material, wherein the heater is arranged to heat the aerosolizable material in use, wherein the aerosolizable material includes at least two sections having different compositions.

4 Claims, 6 Drawing Sheets

(51) Int. Cl.

| | |
|---|---|
| ***A24C 5/47*** | (2006.01) |
| ***A24D 1/20*** | (2020.01) |
| ***A24D 3/17*** | (2020.01) |
| ***A24F 40/20*** | (2020.01) |
| ***A24F 40/30*** | (2020.01) |

(52) U.S. Cl.
CPC ..... *A24F 40/30* (2020.01); *A24C 5/01* (2020.01); *A24F 40/20* (2020.01)

(56) References Cited

U.S. PATENT DOCUMENTS

| | | | | |
|---|---|---|---|---|
| D303,766 | S | 10/1989 | Delbanco | |
| 5,060,671 | A * | 10/1991 | Counts | A24F 40/30 131/329 |
| 5,178,167 | A | 1/1993 | Riggs et al. | |
| D360,281 | S | 7/1995 | Kim | |
| 5,505,214 | A * | 4/1996 | Collins | H05B 3/24 131/194 |
| D422,113 | S | 3/2000 | Higgins et al. | |
| D424,236 | S | 5/2000 | Reed | |
| D446,849 | S | 8/2001 | Weinberg | |
| D512,493 | S | 12/2005 | Haranaka | |
| D576,718 | S | 9/2008 | Nomi et al. | |
| D634,417 | S | 3/2011 | Abbondanzio et al. | |
| D634,832 | S | 3/2011 | Abbondanzio et al. | |
| D654,160 | S | 2/2012 | Yomtov | |
| D677,623 | S | 3/2013 | Fitch et al. | |
| D677,774 | S | 3/2013 | Postma | |
| D696,815 | S | 12/2013 | Abroff | |
| D704,319 | S | 5/2014 | Cai | |
| D708,727 | S | 7/2014 | Postma | |
| D716,267 | S | 10/2014 | Kim et al. | |
| D728,855 | S | 5/2015 | Liu | |
| D729,440 | S | 5/2015 | Liu | |
| D743,099 | S | 11/2015 | Oglesby | |
| D758,656 | S | 6/2016 | Freshwater et al. | |
| D759,296 | S | 6/2016 | Abroff et al. | |
| D768,834 | S | 10/2016 | Schuller et al. | |
| D771,867 | S | 11/2016 | Leidel et al. | |
| D773,114 | S | 11/2016 | Leidel et al. | |
| D775,762 | S | 1/2017 | Chen | |
| D787,657 | S | 5/2017 | Farone et al. | |
| 2004/0025865 | A1 | 2/2004 | Nichols et al. | |
| 2005/0244521 | A1 | 11/2005 | Strickland et al. | |
| 2007/0000505 | A1* | 1/2007 | Zhuang | A24B 15/14 131/342 |
| 2008/0092912 | A1* | 4/2008 | Robinson | A24D 1/20 131/200 |
| 2009/0114737 | A1 | 5/2009 | Yu et al. | |
| 2011/0108025 | A1 | 5/2011 | Fink et al. | |
| 2011/0290244 | A1 | 12/2011 | Schennum | |
| 2012/0006346 | A1 | 1/2012 | Inagaki | |
| 2014/0048085 | A1 | 2/2014 | Cox | |
| 2014/0366898 | A1 | 12/2014 | Monsees et al. | |
| 2016/0295922 | A1 | 10/2016 | John | |
| 2016/0309784 | A1* | 10/2016 | Silvestrini | A61M 11/042 |
| 2017/0055576 | A1 | 3/2017 | Beeson et al. | |
| 2017/0164657 | A1 | 6/2017 | Batista | |
| 2017/0231276 | A1 | 8/2017 | Mironov et al. | |
| 2017/0232211 | A1 | 8/2017 | Gallem et al. | |
| 2017/0273358 | A1 | 9/2017 | Batista | |
| 2018/0077966 | A1* | 3/2018 | Malgat | A24D 1/22 |
| 2019/0082735 | A1* | 3/2019 | Phillips | A24F 42/60 |

FOREIGN PATENT DOCUMENTS

| | | | |
|---|---|---|---|
| CN | 105792688 | A | 7/2016 |
| CN | 106255431 | A | 12/2016 |
| CN | 107205491 | A | 9/2017 |
| EA | 011916 | B1 | 6/2009 |
| EA | 030599 | B1 | 8/2018 |
| EM | 0026114260001 | | 3/2015 |
| EP | 0174645 | A2 | 3/1986 |
| EP | 0336458 | A2 | 10/1989 |
| EP | 0337505 | A2 | 10/1989 |
| EP | 0342538 | A2 | 11/1989 |
| EP | 3075272 | A2 | 10/2016 |
| JP | 2010506594 | A | 3/2010 |
| JP | 2015513922 | A | 5/2015 |
| JP | 2016508744 | A | 3/2016 |
| JP | 2016531586 | A | 10/2016 |
| JP | 2017500848 | A | 1/2017 |
| JP | 2017511703 | A | 4/2017 |
| JP | 2017515493 | A | 6/2017 |
| JP | 2017529896 | A | 10/2017 |
| WO | WO-2014139611 | A1 | 9/2014 |
| WO | WO-2015062983 | A2 | 5/2015 |
| WO | WO 2015/166245 | | 11/2015 |
| WO | WO-2015166952 | A1 | 11/2015 |
| WO | WO-2016135342 | A2 | 9/2016 |
| WO | WO-2016207407 | A1 | 12/2016 |
| WO | 2017198874 | A1 | 11/2017 |
| WO | WO 2017186946 | | 11/2017 |
| WO | WO-2017194764 | A1 | 11/2017 |

OTHER PUBLICATIONS

Application and Filing Receipt for U.S. Appl. No. 29/557,914, filed Mar. 14, 2016, 280 pages, inventor(s): Powell et al.
Decision to Grant mailed Jan. 18, 2017 for Russian Application No. 2016503074, 4 pages.
International Preliminary Report on Patentability for Application No. PCT/EP2018/081393, mailed on Jun. 11, 2020, 11 pages.
International Search Report and Written Opinion for Application No. PCT/EP2019/051804, mailed on May 14, 2019, 11 pages.
Notice of Reasons for Rejection for Japanese Application No. 2020-522353, mailed on Jul. 13, 2021, 4 pages.
Office Action and Search Report mailed Sep. 23, 2020 for Russian Application No. 2020117446, filed Nov. 15, 2018, 13 pages.
Office Action for Canadian Application No. 3,083,673 mailed on Jul. 9, 2021, 5 pages.
Office Action For Japanese Application No. 2020-537147, mailed on Jun. 29, 2021, 3 pages.
Uranaka T., et al., "British American Tobacco to Test Tobacco E-cigarette in Japan," Nov. 8, 2016, Retrieved from http://www.reuters.com/article/us-brit-am-tobacco-ecigarettes-idUSKBN1330AG on Apr. 7, 2017, 4 pages.
Written Opinion for Application No. PCT/EP2018/081393, mailed on May 14, 2019, 9 pages.
Office Action for Japanese Patent Application No. 2020-522353 mailed on Feb. 8, 2022, 10 pages.
First Office action mailed Nov. 24, 2022 for Chinese Application No. 201880070112.0 filed Nov. 15, 2018, 22 pages.
"Invitation to Pay Additional Fees for the PCT patent application No. PCT/EP2018/081393 mailed on Feb. 21, 2019", 10 pages.
"Office Action received for Ukrainian Patent Application No. a202002642, mailed on Sep. 4, 2023", 5 pages (Official Copy Only).

* cited by examiner

AEROSOL GENERATION

PRIORITY CLAIM

The present application is a National Phase entry of PCT Application No. PCT/EP2018/081393, filed Nov. 15, 2018, which claims priority from GB Patent Application No. 1719747.6, filed Nov. 28, 2017, each of which is hereby fully incorporated herein by reference.

TECHNICAL FIELD

The present disclosure relates to aerosol generation and particularly, although not exclusively, to an aerosol generating assembly, a method of generating an aerosol, an aerosolizable material for use in generating an aerosol and an aerosol generating article for use in an aerosol generating assembly.

BACKGROUND

Smoking articles such as cigarettes, cigars and the like burn tobacco during use to create tobacco smoke. Alternatives to these types of articles release compounds without burning.

Apparatus is known that heats aerosolizable material to volatilize at least one component of the aerosolizable material, typically to form an aerosol which can be inhaled, without burning or combusting the aerosolizable material. Such apparatus is sometimes described as a "heat-not-burn" apparatus or a "tobacco heating product" (THP) or "tobacco heating device" or similar. Various different arrangements for volatilizing at least one component of the aerosolizable material are known.

The material may be for example tobacco or other non-tobacco products or a combination, such as a blended mix, which may or may not contain nicotine.

Some known tobacco heating devices include more than one heater, with each heater configured to heat different parts of the aerosolizable material in use. This then allows the different parts of the aerosolizable material to be heated at different times so as to provide longevity of aerosol formation over the use lifetime.

SUMMARY

According to a first aspect of the present disclosure, there is provided an aerosol generating assembly comprising a heater and an aerosolizable material, wherein the heater is arranged to heat the aerosolizable material in use, wherein the aerosolizable material comprises at least two sections having different compositions.

The use of two or more sections containing different compositions allows the composition of the inhaled aerosol to be selectively tuned.

In some cases, the assembly may be configured to provide a different heat profile to each of the aerosolizable material sections having different compositions.

In some examples of the aerosol generating assembly, the aerosolizable material has a rod shape. In some cases, the at least two sections are cylindrical and each is arranged coaxially along the rod of aerosolizable material In some examples, the composition in a first section of the aerosolizable material is depleted in one or more volatile components relative to the composition in a second section. In some cases, the aerosol generating assembly may be configured such that heating of the first section of aerosolizable material is initiated prior to heating of the second section.

Another example provides an aerosol generating assembly comprising at least two heaters, wherein the heaters are arranged to respectively heat different sections of the aerosolizable material.

Another example provides an aerosol generating assembly in which the aerosolizable material comprises a tobacco rod, and the tobacco rod comprises at least two sections having different tobacco compositions.

A second aspect of the disclosure provides a method of generating an aerosol comprising heating an aerosolizable material, wherein the aerosolizable material includes at least two sections having different compositions.

In some cases, the method provides a different heat profile to each of the aerosolizable material sections having different compositions.

In some cases, method involves heating an aerosolizable material that has a rod shape. In some examples, the at least two sections are cylindrical and are arranged coaxially along the rod aerosolizable material.

In some cases, the method comprises heating an aerosolizable material in which the composition in a first section of the aerosolizable material is depleted in one or more volatile components relative to the composition in a second section.

In some instances, the method comprises initiating heating of the first section of aerosolizable material prior to heating of the second section.

A third aspect of the disclosure provides an aerosolizable material for use in an aerosol generating assembly, wherein the aerosolizable material comprises at least two sections having different compositions. In some cases, the aerosolizable material is or comprises a tobacco rod, and the tobacco rod comprises at least two sections having different tobacco compositions.

In some cases, the aerosolizable material is configured such that the section that is heated first in use is relatively depleted in one or more volatile components compared to the section that is heated second in use.

A further aspect of the disclosure provides an aerosol generating article for use in an aerosol generating assembly, the aerosol generating article comprising an aerosolizable material according to the third aspect and a cooling element and/or a filter. In some cases, the cooling element may be arranged between the aerosolizable material and the filter. In some cases, the filter may be arranged between the aerosolizable material and the cooling element.

A further aspect of the disclosure provides a method of making an aerosol generating article according to the previous aspect, wherein the method comprises providing an aerosolizable material containing two different compositions, and wrapping the aerosolizable material and the cooling element and/or filter in a wrapper material.

BRIEF DESCRIPTION OF THE DRAWINGS

Further features and advantages of the disclosure will become apparent from the following description of examples of the disclosure, given by way of example only, which is made with reference to the accompanying drawings.

DETAILED DESCRIPTION

Figure 1:
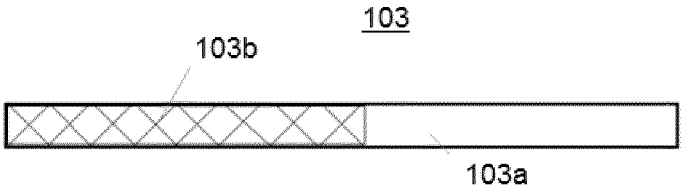
FIG. 1 is a schematic view of an aerosolizable material for use in an aerosol generating assembly.

The aerosol generating assembly according to examples of the disclosure may also be referred to herein as a heat not burn device, a tobacco heating product or a tobacco heating device.

In some cases, the assembly is configured to provide a different heat profile to each of the aerosolizable material sections having different compositions. This allows the flavor profile of the inhaled aerosol to be tuned. In some cases, the assembly may be configured to supply an aerosol in which the aerosol composition changes over the use lifetime. In other cases, the assembly may be configured to supply an aerosol in which the aerosol composition is substantially uniform over the use lifetime.

In some cases, the assembly may be configured such that at least a portion of the aerosolizable material is exposed to a temperature of at least 180° C. or 200° C. for at least 50% of the heating period. In some examples, the aerosolizable material may be exposed to a heat profile as described in co-pending application PCT/EP2017/068804, the contents of which are incorporated herein in their entirety.

In some particular cases, an assembly is provided which is configured to heat the at least two sections of the aerosolizable material separately. By controlling the temperature of the first and second sections over time such that the temperature profiles of the sections are different, it is possible to control the puff profile of the aerosol during use. The heat provided to the two portions of the aerosolizable material may be provided at different times or rates; staggering the heating in this way may allow for both fast aerosol production and longevity of use.

In one particular example, the assembly may be configured such that on initiation of the consumption experience, a first heating element corresponding to a first section of the aerosolizable material is immediately heated to a temperature of 240° C. This first heating element is maintained at 240° C. for 145 seconds and then drops to 135° C. (where it remains for the rest of the consumption experience). 75 seconds after initiation of the consumption experience, a second heating element corresponding to a second section of the aerosolizable material is heated to a temperature of 160° C. 135 seconds after initiation of the consumption experience, the temperature of the second heating element is raised to 240° C. (where it remains for the rest of the consumption experience). The consumption experience lasts 280 seconds, at which point both heaters are cool to room temperature.

In some cases, the composition in a first section of the aerosolizable material is depleted in one or more volatile components relative to the composition in a second section. In particular, in some cases, the assembly may be configured such that heating of the first section of aerosolizable material is initiated prior to heating of the second section. In some cases, the assembly may be configured such that heating of the first section of aerosolizable material is concluded prior to initiation of heating of the second section.

The inventors have established that in some known aerosol generating assemblies, in which a uniform aerosolizable material is used, the delivery of components of the aerosol reduces over the use lifetime. Where only one heater is used in such prior art assemblies, the most volatile components of the aerosolizable material are consumed quickly and the delivery of such components generally reduces puff-by-puff.

In some other known assemblies, more than one heater is used and these heaters are arranged to heat different parts of the aerosolizable material, with the intention that parts of the aerosolizable material are not heated initially, thereby saving the volatiles in those parts for consumption later in the product use lifetime. However, the inventors have determined that bleeding of heat between different heating zones in such assemblies causes depletion of volatiles in zones where direct heating has not yet been initiated. This increases the delivery of such volatiles early in the consumption period, and reduces the levels of such volatiles available for consumption later. Thus, the delivery of such volatile components generally reduces puff-by-puff.

The inventors have established that initially heating a first section of the aerosolizable material that is relatively depleted in volatiles, and subsequently heating a second section that is relatively enhanced in volatiles, improves the puff profile.

In some cases, a relatively consistent aerosol delivery per puff is possible because the volatile delivery during heating for the first section is enhanced by heat migration within the assembly resulting in some consumption of volatiles from the second section.

In other cases, the enhanced levels of volatiles in the second section can be used to provide an aerosol in which the volatile delivery per puff increases over time. In such cases, and where the aerosolizable material comprises tobacco, the nicotine and/or tobacco flavor sensation may be stronger at the end of the smoking period. This mimics the smoking sensation of a combustible smoking article (cigarettes, cigars and the like).

In some cases, there are two sections in the aerosolizable material. In other cases, there may be 3, 4, 5 or more sections. The composition in each section may be the same or different, provided that the composition in at least 2 of the sections is different. In some cases, the assembly comprises a plurality of heaters, arranged such that each directly heats one or more sections of the aerosolizable material. In some cases, the number of heaters is equivalent to the number of sections in the aerosolizable material, and the heaters are arranged such that each heats one section.

In some examples, the aerosolizable material may be provided as part of an aerosol generating article which is inserted into the aerosol generating assembly. In some cases, the aerosol generating article may comprise the aerosolizable material and additionally a cooling element and/or a filter. The cooling element, if present, may act or function to cool gaseous or aerosol components. In some cases, it may act to cool gaseous components such that they condense to form an aerosol. It may also act to space the very hot parts of the apparatus from the user. The filter, if present, may comprise any suitable filter known in the art such as a cellulose acetate plug. The aerosol generating article may be circumscribed by a wrapping material such as paper.

The aerosol generating article may additionally comprise ventilation apertures. These may be provided in the sidewall of the article. In some cases, the ventilation apertures may be provided in the filter and/or cooling element. These apertures may allow cool air to be drawn into the article during use, which can mix with the heated volatilized components thereby cooling the aerosol.

The ventilation enhances the generation of visible heated volatilized components from the article when it is heated in use. The heated volatilized components are made visible by the process of cooling the heated volatilized components such that supersaturation of the heated volatilized components occurs. The heated volatilized components then undergo droplet formation, otherwise known as nucleation, and eventually the size of the aerosol particles of the heated volatilized components increases by further condensation of the heated volatilized components and by coagulation of newly formed droplets from the heated volatilized components.

In some cases, the ratio of the cool air to the sum of the heated volatilized components and the cool air, known as the ventilation ratio, is at least 15%. A ventilation ratio of 15% enables the heated volatilized components to be made visible by the method described above. The visibility of the heated volatilized components enables the user to identify that the volatilized components have been generated and adds to the sensory experience of the smoking experience.

In another example, the ventilation ratio is between 50% and 85% to provide additional cooling to the heated volatilized components. In some cases, the ventilation ratio may be at least 60% or 65%.

In some cases, the aerosolizable material has a rod shape, such as a cylinder. In some cases, the sections of the aerosolizable material may be cylindrical and arranged coaxially along the rod of aerosolizable material. In some cases, the cylindrical sections may each have the same dimensions. In other cases, the cylindrical sections may have different dimensions. In some cases, the cylindrical sections may have a cross-sectional diameter of approximately 5-9 mm, suitably 7.5-8 mm. In some cases, the total length of the rod may be about 30-54 mm, suitably 36-48 mm. In some cases, the rod may comprise two sections, each having a length of about 15-27 mm, suitably 18-24 mm. In some cases, the rod may comprise two sections, each having a length of about 15-20 mm, suitably about 18 mm. In some cases, the rod may comprise two sections, each having a length of about 22-27 mm, suitably about 24 mm.

In other cases, the sections of the aerosolizable material may be in the form of prismatic sections that are arranged to together form a rod such as a cylinder. For example, in the case where there are two sections, they may be hemicylindrical and arranged with their respective planar faces in contact.

In some cases, the aerosolizable material may comprise about 300-500 mg of tobacco. In some cases, each of the sections may contain an equal amount of tobacco. In some cases, the sections may contain different amounts of tobacco. In some cases, the aerosolizable material comprises about 300-380 mg, suitably about 330-350 mg of tobacco. In some cases, the aerosolizable material comprises about 420-500 mg, suitably about 450-470 mg of tobacco. In some cases, the material comprises two sections, each containing the same amount of tobacco.

In some particular cases, the aerosolizable material has a rod shape and is formed from two cylindrical sections arranged coaxially along the rod of aerosolizable material. In some examples, the cylindrical sections each comprise about 150-190 mg, suitably about 165-175 mg of tobacco and have a length of about 15-20 mm, suitably about 18 mm. In some other examples, the cylindrical sections each comprise about 210-250 mg, suitably about 225-235 mg of tobacco and have a length of about 22-27 mm, suitably about 24 mm.

In a tobacco heating product, the tobacco section that is heated second typically loses volatile components when the first section is heated. Accordingly, the tobacco rod for use with an aerosol generating assembly described herein may be such that the second section is enhanced in volatiles relative to the first section, to account for losses of volatiles as the first section is heated.

As used herein, the term "rod" generally refers to an elongate body which may be any suitable shape for use in an aerosol generating assembly. In some cases, the rod is substantially cylindrical.

As disclosed above, the aerosolizable material (or at least one section thereof) may be or may comprise a tobacco rod. A tobacco rod may comprise any solid material comprising tobacco or derivatives thereof. The tobacco may be any suitable solid tobacco material, such as single grades or blends, cut rag or whole leaf, ground tobacco, tobacco fiber, cut tobacco, extruded tobacco, tobacco stem and/or reconstituted tobacco. The tobacco may be of any type including, without limitation, Virginia and/or Burley and/or Oriental tobacco. In some cases, the sections containing different tobacco compositions may contain different tobacco blends.

As used herein, the terms "volatiles", "volatile components" and the like may refer to any components of the inhaled aerosol including, but not limited to, aerosol generating agents, flavorants, tobacco flavors and aromas, water and nicotine.

The different sections of aerosolizable material may differ in their content of one or more of aerosol generating agents, flavorants, tobacco flavors and aromas, water and nicotine. In some cases, this may be achieved through the use of different tobacco blends.

As used herein, an "aerosol generating agent" is an agent that promotes the generation of an aerosol on heating. An aerosol generating agent may promote the generation of an aerosol by promoting an initial vaporization and/or the condensation of a gas to an inhalable solid and/or liquid aerosol. Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate.

As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In use, in some cases, the aerosol generating article may arranged in an aerosol generating device which heats the article to generate an aerosol without burning. In some other cases, the article may be provided in an assembly with a fuel source, such as a combustible fuel source or chemical heat source, which heats but does not burn the aerosolizable material.

In some cases, the heater provided in an aerosol generating assembly may be a thin film, electrically resistive heater. In other cases, the heater may comprise an induction heater or the like. Where more than one heater is present, each heater may be the same or different.

Generally, the or each heater is connected to a battery, which may be a rechargeable battery or a non-rechargeable battery. Examples of suitable batteries include for example a lithium-ion battery, a nickel battery (such as a nickel-cadmium battery), an alkaline battery and/or the like. The battery is electrically coupled to the heater and is controllable via appropriate circuitry to supply electrical power when required to heat the aerosolizable material (to volatilize components of the aerosolizable material without causing the aerosolizable material to burn).

In one example, the heater is generally in the form of a hollow cylindrical tube, having a hollow interior heating chamber into which the aerosolizable material is inserted for heating in use. Different arrangements for the heater are possible. For example, the heater may be formed as a single heater or may be formed of plural heaters aligned along the longitudinal axis of the heater. (For simplicity, reference to a "heater" herein shall be taken to include plural heaters, unless the context requires otherwise.) The heater may be annular or tubular. The heater may be dimensioned so that substantially the whole of the aerosolizable material when inserted is located within the heating element(s) of the heater so that substantially the whole of the aerosolizable material is heated in use. The heater may be arranged so that selected zones of the aerosolizable material can be independently heated, for example in turn (sequentially) or together (simultaneously) as desired.

The heater may be surrounded along at least part of its length by a thermal insulator which helps to reduce heat passing from the heater to the exterior of the aerosol generating assembly. This helps to keep down the power requirements for the heater as it reduces heat losses generally. The insulator also helps to keep the exterior of the aerosol generating assembly cool during operation of the heater.

To the extent that they are compatible, features described in relation to one aspect of the disclosure are explicitly disclosed in combination with the other aspects and examples described herein.

FIG. 1 illustrates schematically an example of an aerosolizable material for use with an aerosol generating assembly. The aerosolizable material is in the form of a cylindrical rod and comprises a first section 103*a* and a second section 103*b*. The second section 103*b* is, in this example, further from the mouth in use than the first section 103*a*.

The two sections 103*a*, 103*b* have different compositions. In one example, the second section 103*b* is enriched in volatile components relative to the first section 103*a*. In this case, the first section 103*a* (nearer to the mouth-end of the assembly) is heated first in use. In another example, the second section 103*b* is depleted in volatile components relative to the first section 103*a* and, in this case, the second section (further from the mouth-end of the aerosol generating article 101) is heated first in use.

Figure 2:
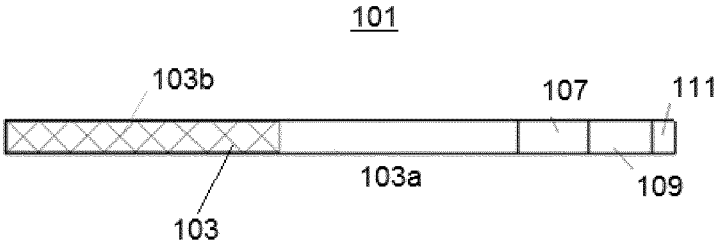
FIG. 2 is a schematic view of an aerosol generating article comprising an aerosolizable material for use in an aerosol generating assembly.

FIG. 2 illustrates schematically an example of an aerosol generating article 101 for use with an aerosol generating assembly. The aerosol generating article 101 includes, the cylindrical rod of aerosolizable material 103 illustrated in FIG. 1, a cooling element 107, a filter 109 and a mouth-end segment 111. The cooling element 107 and filter 109, as illustrated, may be arranged between the mouth-end of the aerosolizable material 103 and the mouth-end segment 111, so that flow from the aerosolizable material 103 passes through the cooling element 107 and filter 109 (or vice versa if the filter is arranged before the cooling element in the flow) before reaching the user. Although the example in FIG. 2 illustrates a cooling element 107, a filter 109 and a mouth-end segment 111, one or more of these elements may be omitted in other examples.

In some examples, the mouth-end segment, if present, 111 may be formed of for example paper, for example in the form of a spirally wound paper tube, cellulose acetate, cardboard, crimped paper, such as crimped heat resistant paper or crimped parchment paper, and/or polymeric materials, such as low density polyethylene (LDPE), or some other suitable material. The mouth-end segment 111 may comprise a hollow tube. Such a hollow tube may provide a filtering function to filter volatilized aerosolizable material. The mouth-end segment 111 may be elongate, in order to be spaced from the very hot part(s) of the main apparatus (not shown) that heats the aerosolizable material.

In some examples, the filter 109, if present, may be a filter plug, and may be made, for example, from cellulose acetate.

In some cases, the cooling element 107, if present, may comprise a monolithic rod having first and second ends and comprising plural through holes extending between the first and second ends. The through holes may extend substantially parallel to the central longitudinal axis of the rod. The through holes of the cooling element 107 may be arranged generally radially of the element when viewed in lateral cross-section. That is, in an example, the element has internal walls which define the through holes and which have two main configurations, namely radial walls and central walls. The radial walls extend along radii of the cross-section of the element and the central walls are centered on the center of the cross-section of the element. The central walls in one example are circular, though other regular or irregular cross-sectional shapes may be used. Likewise, the cross-section of the element in one example is circular, though other regular or irregular cross-sectional shapes may be used.

In an example, the majority of the through holes have a hexagonal or generally hexagonal cross-sectional shape. In this example, the element has what might be termed a "honeycomb" structure when viewed from one end.

In some cases, the cooling element 107 may comprise a hollow tube which spaces the filter 109, if present, from the very hot part(s) of the main apparatus that heats the aerosolizable material. The cooling element 107 may be formed of for example paper, for example in the form of a spirally wound paper tube, cellulose acetate, cardboard, crimped paper, such as crimped heat resistant paper or crimped parchment paper, and polymeric materials, such as low density polyethylene (LDPE), or some other suitable material.

The cooling element 107, if present, may be substantially incompressible. It may be formed of a ceramic material, or of a polymer, for example a thermoplastic polymer, which may be an extrudable plastics material. In an example, the porosity of the element is in the range 60% to 75%. The porosity in this sense may be a measure of the percentage of the lateral cross-sectional area of the element occupied by the through holes. In an example, the porosity of the element is around 69% to 70%.

Other examples of a cooling element are disclosed in PCT/GB2015/051253, the entirety of which is hereby expressly incorporated by reference, in particular in FIGS. 1 to 8 and the description from page 8, line 11 to page 18, line 16.

In further examples, the cooling element 107 may be formed from a sheet material that is folded, crimped or pleated to form through holes. The sheet material may be made, for example, from metal such as aluminum; polymeric plastics material such as polyethylene, polypropylene, polyethylene terephthalate, or polyvinyl chloride; or paper.

In some examples, the cooling element 107 and the filter 109 may be held together by a wrapper paper (not shown) to form an assembly. The assembly may then be joined to the aerosolizable material by a further wrapper (not shown) which circumscribes the assembly and at least the mouth end of the aerosolizable material to form the aerosol generating article 101. In other examples, the aerosol generating article 101 is formed by wrapping the cooling element 107, the filter 109 and the aerosolizable material 103 effectively in one operation, with no separate tipping paper being provided for the cooling element and/or filter components (if present).

Figure 3:
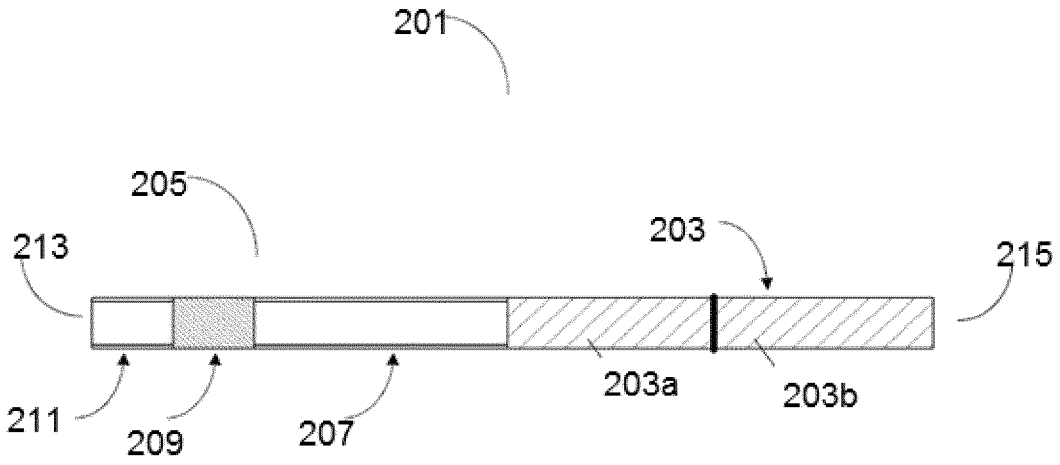
FIG. 3 shows a section view of an example of an aerosol generating article.
Figure 4:
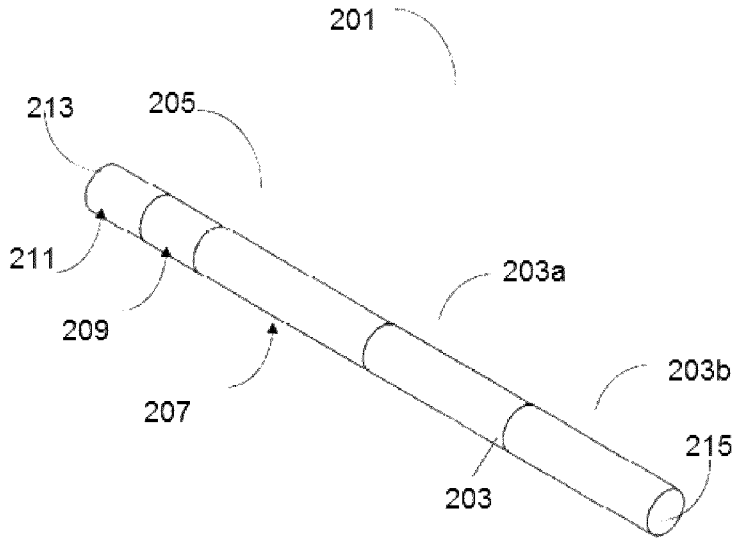
FIG. 4 shows a perspective view of the article of FIG. 3.

Referring now to FIGS. 3 and 4, there are shown a partially cut-away section view and a perspective view of an example of an aerosol generating article 201. The article 201 is adapted for use with device having a power source and a heater. The article 201 of this embodiment is particularly suitable for use with the device 1 shown in FIGS. 7 to 9, described below. In use, the article 201 may be removably inserted into the device shown in FIG. 7 at an insertion point 20 of the device 1.

The article 201 of one example is in the form of a substantially cylindrical rod that includes a body of aerosolizable material 203 and a filter assembly 205 in the form of a rod. The aerosolizable material has two sections 203*a*, 203*b* which have a different composition to one another. In some cases, the two sections 203*a*, 203*b* of aerosolizable material 203 may be joined together by annular tipping paper (not shown), which is located substantially around the circumference of the aerosolizable material 203.

The filter assembly 205 includes three segments, a cooling segment 207, a filter segment 209 and a mouth end segment 211. The article 201 has a first end 213, also known as a mouth end or a proximal end and a second end 215, also known as a distal end. The body of aerosolizable material 203 is located towards the distal end 215 of the article 201. In one example, the cooling segment 207 is located adjacent the body of aerosolizable material 203 between the body of aerosolizable material 203 and the filter segment 209, such that the cooling segment 207 is in an abutting relationship with the aerosolizable material 203 and the filter segment 209. In other examples, there may be a separation between the body of aerosolizable material 203 and the cooling segment 207 and between the body of aerosolizable material 203 and the filter segment 209. The filter segment 209 is located in between the cooling segment 207 and the mouth end segment 211. The mouth end segment 211 is located towards the proximal end 213 of the article 201, adjacent the filter segment 209. In one example, the filter segment 209 is in an abutting relationship with the mouth end segment 211. In one embodiment, the total length of the filter assembly 205 is between 37 mm and 45 mm, suitably 41 mm.

In one embodiment, the sections of aerosolizable material 203 each comprise tobacco. However, in other respective embodiments, the sections of aerosolizable material 203 may consist of tobacco, may consist substantially entirely of tobacco, may comprise tobacco and aerosolizable material other than tobacco, may comprise aerosolizable material other than tobacco, or may be free of tobacco. The aerosolizable material may include an aerosol forming agent, such as glycerol, and/or a flavorant.

In some examples, the body of aerosolizable material 203 is between 30 mm and 54 mm in length, suitably between 36 mm and 48 mm in length. The sections of aerosolizable material may be the same length as each other (i.e. half of the total length in embodiments with two sections of aerosolizable material 203).

In one example, the total length of the article 201 is between 71 mm and 95 mm, suitably between 79 mm and 87 mm, suitably about 83 mm.

An axial end of the body of aerosolizable material 203 is visible at the distal end 215 of the article 201. However, in other embodiments, the distal end 215 of the article 201 may comprise an end member (not shown) covering the axial end of the body of aerosolizable material 203.

The body of aerosolizable material 203 is joined to the filter assembly 205 by annular tipping paper (not shown), which is located substantially around the circumference of the filter assembly 205 to surround the filter assembly 205 and extends partially along the length of the body of aerosolizable material 203. In one example, the tipping paper is made of 58GSM standard tipping base paper. In one example, the tipping paper has a length of between 42 mm and 50 mm, suitably about 46 mm.

In some cases, the same tipping paper may be used to join the sections 203*a*, 203*b* of aerosolizable material 203 and the filter assembly 205.

In one example, the cooling segment 207 is an annular tube and is located around and defines an air gap within the cooling segment. The air gap provides a chamber for heated volatilized components generated from the body of aerosolizable material 203 to flow. The cooling segment 207 is hollow to provide a chamber for aerosol accumulation yet rigid enough to withstand axial compressive forces and bending moments that might arise during manufacture and whilst the article 201 is in use during insertion into the device 1. In one example, the thickness of the wall of the cooling segment 207 is approximately 0.29 mm.

The cooling segment 207 provides a physical displacement between the aerosolizable material 203 and the filter segment 209. The physical displacement provided by the cooling segment 207 will provide a thermal gradient across the length of the cooling segment 207. In one example the cooling segment 207 is configured to provide a temperature differential of at least 40 degrees Celsius between a heated volatilized component entering a first end of the cooling segment 207 and a heated volatilized component exiting a second end of the cooling segment 207. In one example the cooling segment 207 is configured to provide a temperature differential of at least 60 degrees Celsius between a heated volatilized component entering a first end of the cooling segment 207 and a heated volatilized component exiting a second end of the cooling segment 207. This temperature differential across the length of the cooling element 207 protects the temperature sensitive filter segment 209 from the high temperatures of the aerosolizable material 203 when it is heated by the heating arrangement of the device 1. If the physical displacement was not provided between the filter segment 209 and the body of aerosolizable material 203 and the heating elements of the device 1, then the temperature sensitive filter segment may 209 become damaged in use, so it would not perform its required functions as effectively.

In one example the length of the cooling segment 207 is at least 15 mm. In one example, the length of the cooling segment 207 is between 20 mm and 30 mm, suitably 23 mm to 27 mm or 25 mm to 27 mm, most suitably about 25 mm.

The cooling segment 207 may be made of paper, which means that it comprises a material that does not generate compounds of concern, for example, toxic compounds when in use adjacent to the heater arrangement of the device 1. In one example, the cooling segment 207 is manufactured from a spirally wound paper tube which provides a hollow internal chamber yet maintains mechanical rigidity. Spirally wound paper tubes are able to meet the tight dimensional accuracy requirements of high-speed manufacturing processes with respect to tube length, outer diameter, roundness and straightness.

In another example, the cooling segment 207 is a recess created from stiff plug wrap or tipping paper. The stiff plug wrap or tipping paper is manufactured to have a rigidity that is sufficient to withstand the axial compressive forces and bending moments that might arise during manufacture and whilst the article 201 is in use during insertion into the device 1.

The filter segment 209 may be formed of any filter material sufficient to remove one or more volatilized compounds from heated volatilized components from the aerosolizable material. In one example the filter segment 209 is made of a mono-acetate material, such as cellulose acetate. The filter segment 209 provides cooling and irritation-reduction from the heated volatilized components without depleting the quantity of the heated volatilized components to an unsatisfactory level for a user.

The density of the cellulose acetate tow material of the filter segment 209 controls the pressure drop across the filter segment 209, which in turn controls the draw resistance of the article 1. Therefore the selection of the material of the filter segment 209 is important in controlling the resistance to draw of the article 201. In addition, the filter segment performs a filtration function in the article 201.

In one example, the filter segment 209 is made of a 8Y15 grade of filter tow material, which provides a filtration effect on the heated volatilized material, whilst also reducing the size of condensed aerosol droplets which result from the heated volatilized material which consequentially reduces the irritation and throat impact of the heated volatilized material to satisfactory levels.

The presence of the filter segment 209 provides an insulating effect by providing further cooling to the heated volatilized components that exit the cooling segment 207. This further cooling effect reduces the contact temperature of the user's lips on the surface of the filter segment 209.

One or more flavors may be added to the filter segment 209 in the form of either direct injection of flavored liquids into the filter segment 209 or by embedding or arranging one or more flavored breakable capsules or other flavor carriers within the cellulose acetate tow of the filter segment 209.

In one example, the filter segment 209 is between 6 mm to 10 mm in length, suitably about 8 mm.

The mouth end segment 211 is an annular tube and is located around and defines an air gap within the mouth end segment 211. The air gap provides a chamber for heated volatilized components that flow from the filter segment 209. The mouth end segment 211 is hollow to provide a chamber for aerosol accumulation yet rigid enough to withstand axial compressive forces and bending moments that might arise during manufacture and whilst the article is in use during insertion into the device 1. In one example, the thickness of the wall of the mouth end segment 211 is approximately 0.29 mm.

In one example, the length of the mouth end segment 211 is between 6 mm to 10 mm and suitably about 8 mm.

The mouth end segment 211 may be manufactured from a spirally wound paper tube which provides a hollow internal chamber yet maintains critical mechanical rigidity. Spirally wound paper tubes are able to meet the tight dimensional accuracy requirements of high-speed manufacturing processes with respect to tube length, outer diameter, roundness and straightness.

The mouth end segment 211 provides the function of preventing any liquid condensate that accumulates at the exit of the filter segment 209 from coming into direct contact with a user.

It should be appreciated that, in one example, the mouth end segment 211 and the cooling segment 207 may be formed of a single tube and the filter segment 209 is located within that tube separating the mouth end segment 211 and the cooling segment 207.

Figure 5:
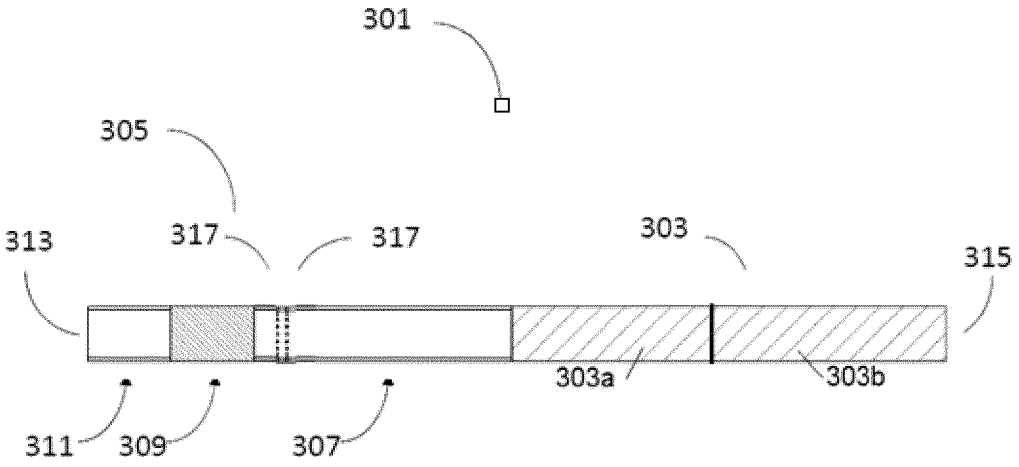
FIG. 5 shows a sectional elevation of an example of an aerosol generating article.
Figure 6:
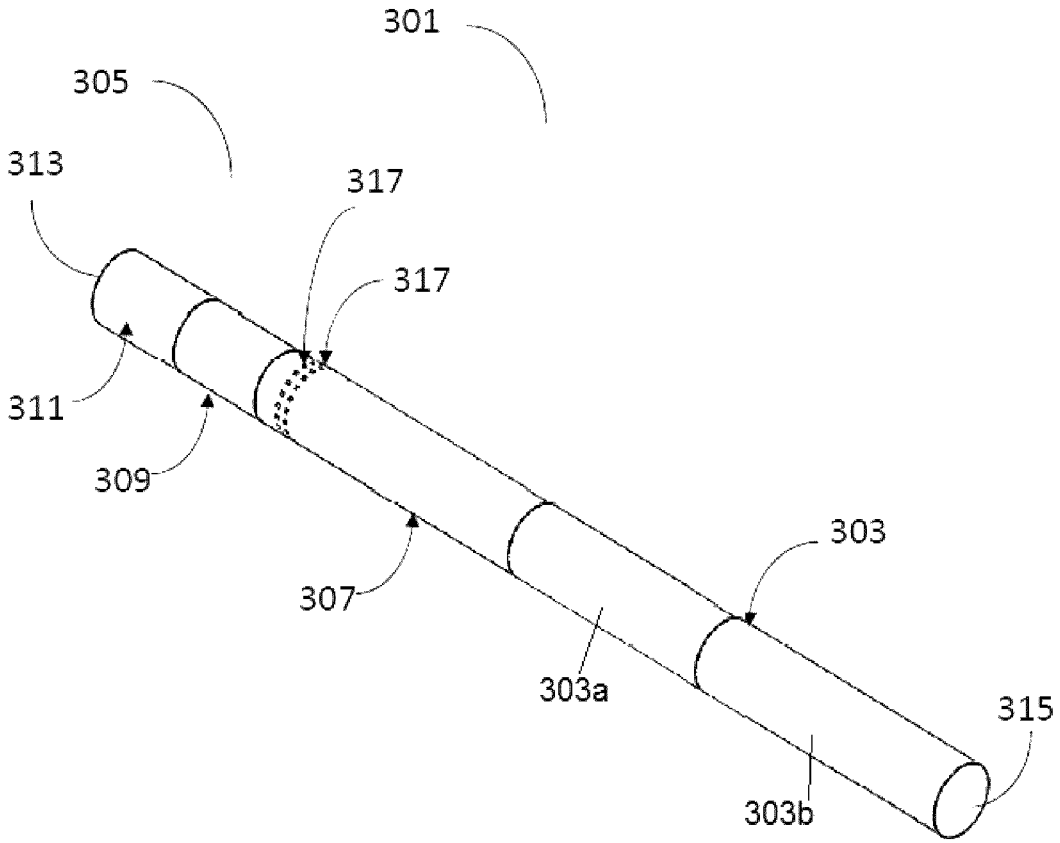
FIG. 6 shows a perspective view of the article of FIG. 5.

Referring now to FIGS. 5 and 6, there are shown a partially cut-away section and perspective views of an example of an article 301 according to an embodiment of the disclosure. The reference signs shown in FIGS. 5 and 6 are equivalent to the reference signs shown in FIGS. 3 and 4, but with an increment of 100.

In the example of the article 301 shown in FIGS. 5 and 6, a ventilation region 317 is provided in the article 301 to enable air to flow into the interior of the article 301 from the exterior of the article 301. In one example the ventilation region 317 takes the form of one or more ventilation holes 317 formed through the outer layer of the article 301. The ventilation holes may be located in the cooling segment 307 to aid with the cooling of the article 301. In one example, the ventilation region 317 comprises one or more rows of holes, and in some case, each row of holes is arranged circumferentially around the article 301 in a cross-section that is substantially perpendicular to a longitudinal axis of the article 301.

In one example, there are between one to four rows of ventilation holes to provide ventilation for the article 301. Each row of ventilation holes may have between 12 to 36 ventilation holes 317. The ventilation holes 317 may, for example, be between 100 to 500 μm in diameter. In one example, an axial separation between rows of ventilation holes 317 is between 0.25 mm and 0.75 mm, suitably 0.5 mm.

In one example, the ventilation holes 317 are of uniform size. In another example, the ventilation holes 317 vary in size. The ventilation holes can be made using any suitable technique, for example, one or more of the following techniques: laser technology, mechanical perforation of the cooling segment 307 or pre-perforation of the cooling segment 307 before it is formed into the article 301. The ventilation holes 317 are positioned so as to provide effective cooling to the article 301.

In one example, the rows of ventilation holes 317 are located at least 11 mm from the proximal end 313 of the article, suitably between 17 mm and 20 mm from the proximal end 313 of the article 301. The location of the ventilation holes 317 is positioned such that user does not block the ventilation holes 317 when the article 301 is in use.

Figure 8:
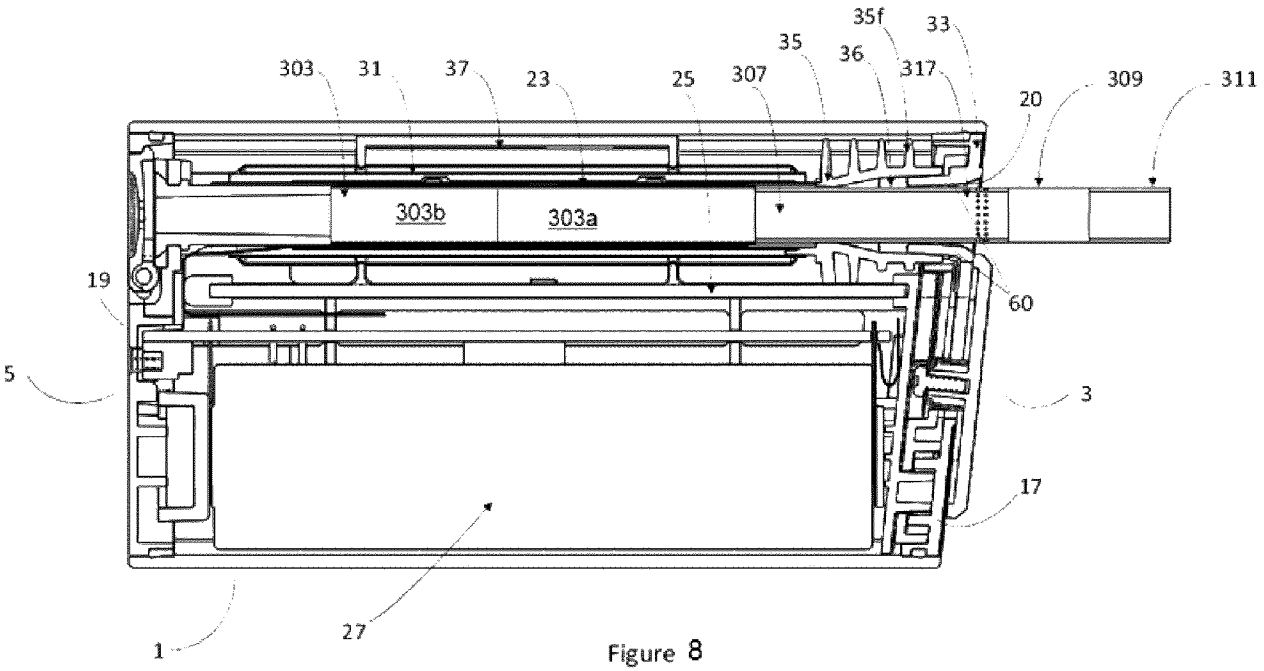
FIG. 8 shows a section view of an example of an aerosol generating assembly.
Figure 9:
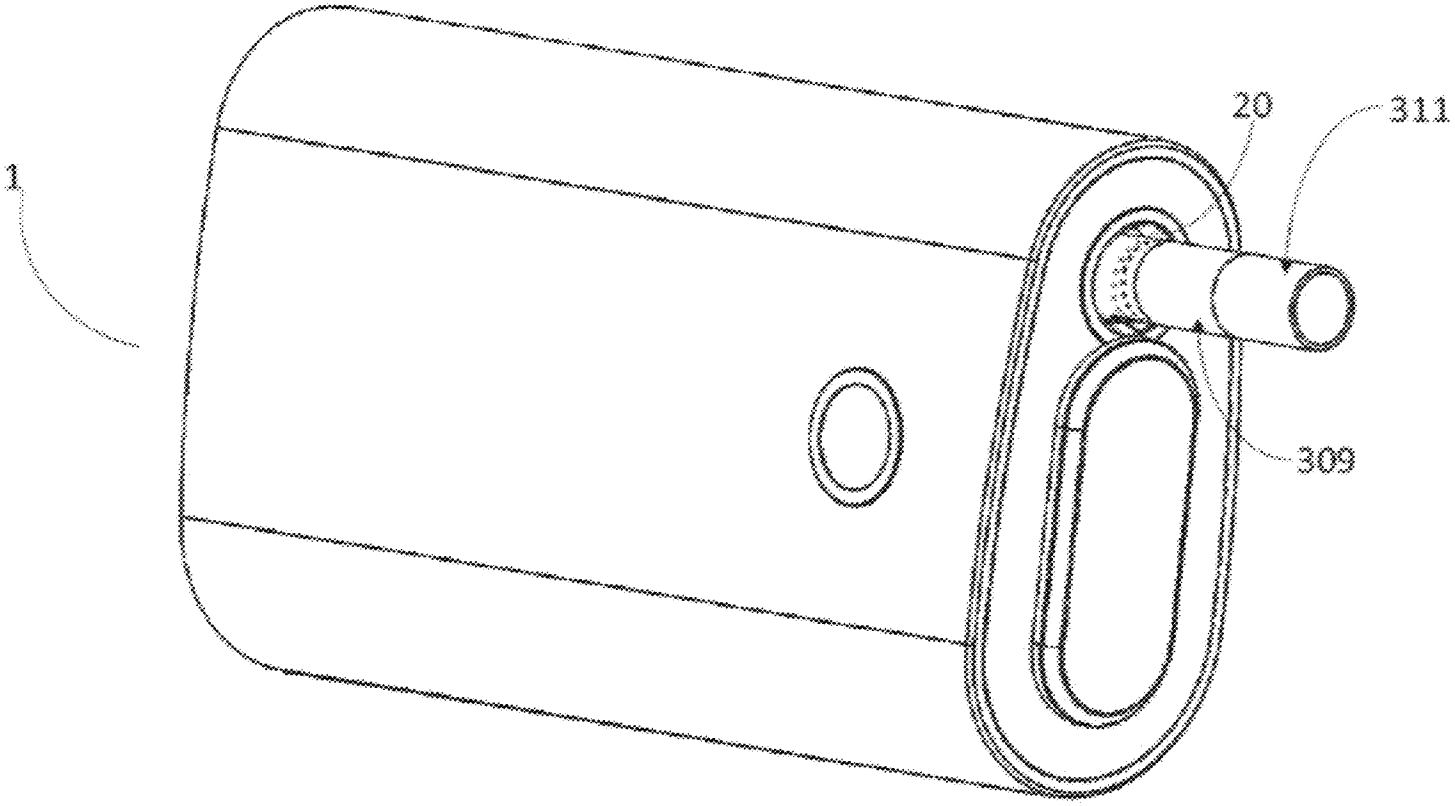
FIG. 9 shows a perspective view of an example of an aerosol generating assembly.

Providing the rows of ventilation holes between 17 mm and 20 mm from the proximal end 313 of the article 301 enables the ventilation holes 317 to be located outside of the device 1, when the article 301 is fully inserted in the device 1, as can be seen in FIGS. 8 and 9. By locating the ventilation holes outside of the device, non-heated air is able to enter the article 301 through the ventilation holes from outside the device 1 to aid with the cooling of the article 301.

The length of the cooling segment 307 is such that the cooling segment 307 will be partially inserted into the device 1, when the article 301 is fully inserted into the device 1. The length of the cooling segment 307 provides a first function of providing a physical gap between the heater arrangement of the device 1 and the heat sensitive filter arrangement 309, and a second function of enabling the ventilation holes 317 to be located in the cooling segment, whilst also being located outside of the device 1, when the article 301 is fully inserted into the device 1. As can be seen from FIGS. 8 and 9, the majority of the cooling element 307 is located within the device 1. However, there is a portion of the cooling element 307 that extends out of the device 1. It is in this portion of the cooling element 307 that extends out of the device 1 in which the ventilation holes 317 are located.

Figure 7:
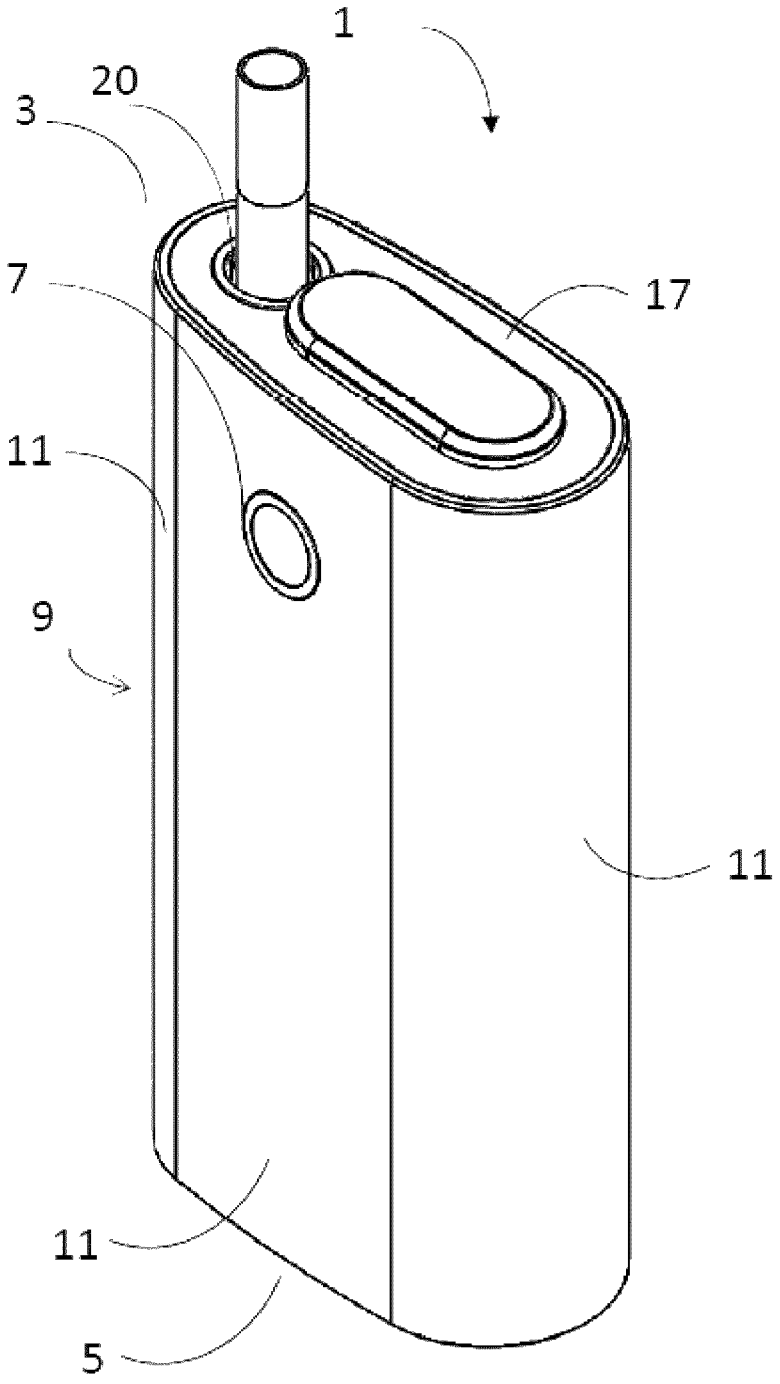
FIG. 7 shows a perspective view of an example of an aerosol generating assembly.

Referring now to FIGS. 7 to 9 in more detail, there is shown an example of a device 1 arranged to heat aerosolizable material to volatilize at least one component of the said aerosolizable material, typically to form an aerosol which can be inhaled. The device 1 is a heating device 1 which releases compounds by heating, but not burning, the aerosolizable material.

A first end 3 is sometimes referred to herein as the mouth or proximal end 3 of the device 1 and a second end 5 is sometimes referred to herein as the distal end 5 of the device 1. The device 1 has an on/off button 7 to allow the device 1 as a whole to be switched on and off as desired by a user.

The device 1 comprises a housing 9 for locating and protecting various internal components of the device 1. In the example shown, the housing 9 comprises a uni-body sleeve 11 that encompasses the perimeter of the device 1, capped with a top panel 17 which defines generally the 'top' of the device 1 and a bottom panel 19 which defines generally the 'bottom' of the device 1. In another example the housing comprises a front panel, a rear panel and a pair of opposite side panels in addition to the top panel 17 and the bottom panel 19.

The top panel 17 and/or the bottom panel 19 may be removably fixed to the uni-body sleeve 11, to permit easy access to the interior of the device 1, or may be "permanently" fixed to the uni-body sleeve 11, for example to deter a user from accessing the interior of the device 1. In an example, the panels 17 and 19 are made of a plastics material, including for example glass-filled nylon formed by injection molding, and the uni-body sleeve 11 is made of aluminum, though other materials and other manufacturing processes may be used.

The top panel 17 of the device 1 has an opening 20 at the mouth end 3 of the device 1 through which, in use, the article 201, 301 including aerosolizable material may be inserted into the device 1 and removed from the device 1 by a user.

The housing 9 has located or fixed therein a heater arrangement 23, control circuitry 25 and a power source 27. In this example, the heater arrangement 23, the control circuitry 25 and the power source 27 are laterally adjacent (that is, adjacent when viewed from an end), with the control circuitry 25 being located generally between the heater arrangement 23 and the power source 27, though other locations are possible.

The control circuitry 25 may include a controller, such as a microprocessor arrangement, configured and arranged to control the heating of the aerosolizable material in the consumable article 201, 301 as discussed further below.

The power source 27 may be for example a battery, which may be a rechargeable battery or a non-rechargeable battery. Examples of suitable batteries include for example a lithium-ion battery, a nickel battery (such as a nickel-cadmium battery), an alkaline battery and/or the like. The battery 27 is electrically coupled to the heater arrangement 23 to supply electrical power when required and under control of the control circuitry 25 to heat the aerosolizable material in the article (as discussed, to volatilize the aerosolizable material without causing the aerosolizable material to burn).

An advantage of locating the power source 27 laterally adjacent to the heater arrangement 23 is that a physically large power source 25 may be used without causing the device 1 as a whole to be unduly lengthy. As will be understood, in general a physically large power source 25 has a higher capacity (that is, the total electrical energy that can be supplied, often measured in Amp-hours or the like) and thus the battery life for the device 1 can be longer.

In one example, the heater arrangement 23 is generally in the form of a hollow cylindrical tube, having a hollow interior heating chamber 29 into which the article 201, 301 comprising the aerosolizable material is inserted for heating in use. Different arrangements for the heater arrangement 23 are possible. For example, the heater arrangement 23 may comprise a single heating element or may be formed of plural heating elements aligned along the longitudinal axis of the heater arrangement 23. The or each heating element may be annular or tubular, or at least part-annular or part-tubular around its circumference. In an example, the or each heating element may be a thin film heater. In another example, the or each heating element may be made of a ceramics material. Examples of suitable ceramics materials include alumina and aluminum nitride and silicon nitride ceramics, which may be laminated and sintered. Other heating arrangements are possible, including for example inductive heating, infrared heater elements, which heat by emitting infrared radiation, or resistive heating elements formed by for example a resistive electrical winding.

In one particular example, the heater arrangement 23 is supported by a stainless steel support tube and comprises a polyimide heating element. The heater arrangement 23 is dimensioned so that substantially the whole of the body of aerosolizable material 203, 303 of the article 201, 301 is inserted into the heater arrangement 23 when the article 201, 301 is inserted into the device 1.

The or each heating element may be arranged so that selected zones of the aerosolizable material can be independently heated, for example in turn (over time) or together (simultaneously) as desired.

The heater arrangement 23 in this example is surrounded along at least part of its length by a thermal insulator 31. The insulator 31 helps to reduce heat passing from the heater arrangement 23 to the exterior of the device 1. This helps to keep down the power requirements for the heater arrangement 23 as it reduces heat losses generally. The insulator 31 also helps to keep the exterior of the device 1 cool during operation of the heater arrangement 23. In one example, the insulator 31 may be a double-walled sleeve which provides a low pressure region between the two walls of the sleeve.

That is, the insulator 31 may be for example a "vacuum" tube, i.e. a tube that has been at least partially evacuated so as to minimize heat transfer by conduction and/or convection. Other arrangements for the insulator 31 are possible, including using heat insulating materials, including for example a suitable foam-type material, in addition to or instead of a double-walled sleeve.

The housing 9 may further comprises various internal support structures 37 for supporting all internal components, as well as the heating arrangement 23.

The device 1 further comprises a collar 33 which extends around and projects from the opening 20 into the interior of the housing 9 and a generally tubular chamber 35 which is located between the collar 33 and one end of the vacuum sleeve 31. The chamber 35 further comprises a cooling structure 35*f*, which in this example, comprises a plurality of cooling fins 35*f* spaced apart along the outer surface of the chamber 35, and each arranged circumferentially around outer surface of the chamber 35. There is an air gap 36 between the hollow chamber 35 and the article 201, 301 when it is inserted in the device 1 over at least part of the length of the hollow chamber 35. The air gap 36 is around all of the circumference of the article 201, 301 over at least part of the cooling segment 307.

The collar 33 comprises a plurality of ridges 60 arranged circumferentially around the periphery of the opening 20 and which project into the opening 20. The ridges 60 take up space within the opening 20 such that the open span of the opening 20 at the locations of the ridges 60 is less than the open span of the opening 20 at the locations without the ridges 60. The ridges 60 are configured to engage with an article 201, 301 inserted into the device to assist in securing it within the device 1. Open spaces (not shown in the Figures) defined by adjacent pairs of ridges 60 and the article 201, 301 form ventilation paths around the exterior of the article 201, 301. These ventilation paths 1 allow hot vapors that have escaped from the article 201, 301 to exit the device 1 and allow cooling air to flow into the device 1 around the article 201, 301 in the air gap 36.

In operation, the article 201, 301 is removably inserted into an insertion point 20 of the device 1, as shown in FIGS. 7 to 9. Referring particularly to FIG. 8, in one example, the body of aerosolizable material 203, 303, which is located towards the distal end 215, 315 of the article 201, 301, is entirely received within the heater arrangement 23 of the device 1. The proximal end 213, 313 of the article 201, 301 extends from the device 1 and acts as a mouthpiece assembly for a user.

In operation, the heater arrangement 23 will heat the consumable article 201, 301 to volatilize at least one component of the aerosolizable material from the body of aerosolizable material 203, 303.

The primary flow path for the heated volatilized components from the body of aerosolizable material 203, 303 is axially through the article 201, 301, through the chamber inside the cooling segment 207, 307, through the filter segment 209, 309, through the mouth end segment 211, 313 to the user. In one example, the temperature of the heated volatilized components that are generated from the body of aerosolizable material is between 60° C. and 250° C., which may be above the acceptable inhalation temperature for a user. As the heated volatilized component travels through the cooling segment 207, 307, it will cool and some volatilized components will condense on the inner surface of the cooling segment 207, 307.

In the examples of the article 301 shown in FIGS. 5 and 6, cool air will be able to enter the cooling segment 307 via the ventilation holes 317 formed in the cooling segment 307. This cool air will mix with the heated volatilized components to provide additional cooling to the heated volatilized components.

The above examples are to be understood as illustrative examples of the disclosure. It is to be understood that any feature described in relation to any one example may be used alone, or in combination with other features described, and may also be used in combination with one or more features of any other of the examples, or any combination of any other of the examples. Furthermore, equivalents and modifications not described above may also be employed without departing from the scope of the invention, which is defined in the accompanying claims.

The invention claimed is:

1. A method of generating an aerosol comprising:

heating, in an aerosol generating assembly, an aerosol generating article comprising an aerosolizable material and a cooling element, wherein the aerosolizable material comprises a tobacco rod having a first section and a second section in abutting, adjacent relation, the first section having a first composition depleted in one or more volatile components relative to a second composition in the second section, wherein heating of the first section of aerosolizable material is initiated prior to heating of the second section, and wherein each of the first section and the second section contain tobacco.

2. The method according to claim 1, further comprising providing a different heat profile to each of the aerosolizable material first and second sections having different compositions.

3. The method according to claim 1, wherein the first and second sections are cylindrical and are arranged coaxially along the tobacco rod of aerosolizable material.

4. The method according to claim 1, wherein the composition in the first section of the aerosolizable material is depleted in one or more volatile components relative to the composition in a second section.

* * * * *